US005167037A

United States Patent [19]

Grilliot et al.

[11] Patent Number: 5,167,037

[45] Date of Patent: * Dec. 1, 1992

[54] UNIVERSALLY ADAPTING COMFORT CHINSTRAP FOR A FIREFIGHTER'S COAT

[76] Inventors: William L. Grilliot; Mary I. Grillot, both of 1986 Home Ave., Dayton, Ohio 45417

[ * ] Notice: The portion of the term of this patent subsequent to Jan. 28, 2009 has been disclaimed.

[21] Appl. No.: 820,428

[22] Filed: Jan. 8, 1992

Related U.S. Application Data

[63] Continuation of Ser. No. 543,377, Jun. 26, 1990, Pat. No. 5,083,319.

[51] Int. Cl.[5] ..... A41D 13/00

[52] U.S. Cl. ..... 2/98; 2/81

[58] Field of Search ..... 2/81, 96, 98, 100, 129, 2/131, 132, 141 R

[56] References Cited

U.S. PATENT DOCUMENTS

| | | | |
|---|---|---|---|
| 808,543 | 12/1905 | Horak | 2/98 |
| 3,231,899 | 2/1966 | Seidel | 2/98 |
| 4,507,806 | 4/1985 | Coombs | 2/81 |
| 4,604,759 | 8/1986 | Bowman | 2/81 |
| 4,748,691 | 6/1988 | Grilliot | 2/81 |
| 4,959,876 | 10/1990 | Kalaam | 2/81 |
| 5,083,319 | 1/1992 | Grilliot | 2/98 |

*Primary Examiner*—Werner H. Schroeder
*Assistant Examiner*—Diana L. Biefeld
*Attorney, Agent, or Firm*—Jacox & Meckstroth

[57] ABSTRACT

A firefighter's coat having a chinstrap which is universally adapting and which automatically properly fits the chin and neck region of a firefighter who wears the firefighter's coat and which is comfortable to the firefighter. The chinstrap has firefighting protective material in one or more layers of material. Each layer of firefighting protective material is capable of change in configuration to accommodate and fit properly the chin and neck region of the firefighter who wears the firefighter's coat. The material of the chinstrap which engages the chin and neck region of the firefighter is relatively soft and comfortable to the firefighter.

15 Claims, 2 Drawing Sheets

UNIVERSALLY ADAPTING COMFORT CHINSTRAP FOR A FIREFIGHTER'S COAT

RELATED APPLICATION

This application is a continuation of patent application Ser. No. 07/543,377, filed Jun. 26, 1990, now U.S. Pat. No. 5,083.319.

BACKGROUND OF THE INVENTION

A firefighter's coat or jacket conventionally includes a chin strap member which protects the neck region of the firefighter from high heat exposure. The chinstrap is conventionally attached to a turned-up collar of the coat or jacket.

Problems exist with regard to the conventional chinstrap. Individual firefighter's have various neck diameters. Chin structure and configuration of firefighters varies significantly. It has been difficult or impossible to provide an adequately protective chinstrap which fits all firefighters comfortably. If a chinstrap is too wide for a firefighter, the chinstrap is uncomfortable. If the chinstrap is too narrow, the chinstrap permits an unprotective gap in the firefighter's chin and neck region. It has been necessary to compromise between a wide chinstrap, for maximum protection, and a narrow chinstrap which may not properly protect the chin and neck region of the firefighters.

Also, a conventional chinstrap is constructed of good firefighting protection material, but the chinstrap is abrasive and uncomfortable rubbing occurs between the firefighter's neck and the chinstrap. If the chinstrap is reduced in dimensions so that it does not rub against the firefighter's neck or chin, the chinstrap may be too small to provide proper protection to the firefighter's neck and chin region.

An object of this invention is to provide a universally adapting chin and neck protective member or chinstrap for a firefighter's coat in which the chin and neck protective member properly covers and protects the neck and chin region of any firefighter who wears the coat, regardless of the shape and size of the firefighter's neck and chin region.

Another object of this invention is to provide such a chin and neck protective member or chinstrap which is comfortable when used by any firefighter who wears the coat, regardless of the shape and size of the firefighter's neck and chin region.

Another object of this invention is to provide such a chinstrap which has good firefighting protective qualities.

Another object of this invention is to provide a chinstrap for a firefighter's coat which chinstrap properly and completely protects the chin and neck region of the firefighter but which does not interfere with the firefighter's mask or facepiece.

Another object of this invention is to provide such a chinstrap which can be easily and readily constructed at relatively low costs.

Other objects and advantages of the firefighter's chinstrap of this invention reside in the construction of parts, the combination thereof, the method of production and the mode of use, as will become more apparent from the following description.

SUMMARY OF THE INVENTION

A chin and neck protective member or chinstrap of this invention is attached or attachable to a firefighter's coat. The chinstrap includes firefighting protective material, such as thermal protective material and moisture protective material. Preferably, the chinstrap comprises an outer shell of flame resistant material. The chinstrap also, preferably, includes moisture barrier material and thermal barrier material which are carried by the outer shell material. The outer shell has two spaced-apart portions. Preferably, the two spaced-apart portions are separated by a recess. The spaced-apart portions are relatively movable. Between the spaced-apart portions and within the recess is a section of stretchable relatively soft thermal protective material. Thus, the stretchable material may be stretched as it engages the chin and neck region of a firefighter who wears the firefighters' coat. Thus, the chinstrap is universally adapting in shape and size to accommodate firefighters who have necks and chins of various sizes and shapes. Furthermore, the chinstrap is comfortable to the firefighter while properly fitting the chin and neck region of the firefighter and providing proper protection to the chin and neck region of the firefighter. The moisture barrier material comprises a section of moisture barrier material which is sufficiently large to permit stretching of the stretchable material.

DETAILED DESCRIPTION OF THE PREFERRED EMBODIMENT

Figure 1:
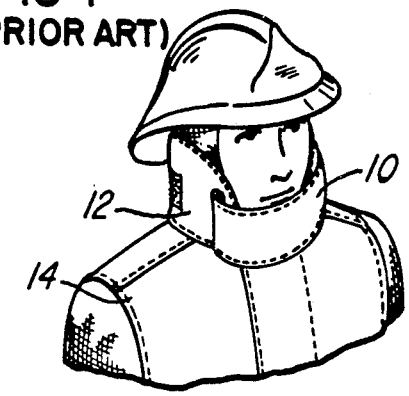
FIG-1 (PRIOR ART)
FIG. 1 is a perspective view showing a portion of a firefighter's coat or jacket and showing a prior art chinstrap as a part of the firefighter's coat.

FIG. 1 shows a prior art chinstrap 10 which is attached to a collar 12 of a firefighter's coat 14. The firefighter's coat 14 and the collar 12 thereof conventionally include an outer shell layer, a thermal barrier layer, and a moisture barrier layer. The outer shell is conventionally of abrasion resistant and flame resistant material. The outer shell has an inner surface which faces the chin and neck region of the firefighter. The outer shell has an outer surface which faces away from the neck and chin region of the firefighter. Within the outer shell and enclosed thereby are one or more layers of thermal protective material and moisture protective material.

The outer shell material is conventionally of the same abrasion resistant and flame resistant material as the outer shell of the coat 14 and the collar 12. Therefore, the surface of the chinstrap 10 which engages the chin and neck region of the firefighter who wears the coat 14 has slight abrasion qualities, and engagement of the chinstrap 10 with the chin and neck of the firefighter is not comfortable to the firefighter. Furthermore, the chinstrap is not designed specifically for the firefighter. Therefore, the neck dimensions and chin structure of the firefighter may be such that the chinstrap 10 does not fit properly upon the neck and chin region of the firefighter. Therefore, a conventional chinstrap, in addition to being uncomfortable to the firefighter may not provide maximum protection to the neck and chin region of the firefighter.

Figure 2:
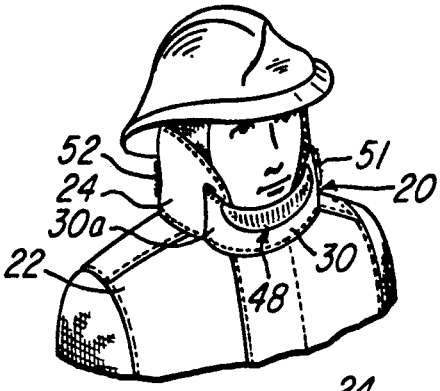
FIG. 2 is a perspective view, similar to FIG. 1, showing a portion of a firefighter's coat or jacket and showing a chin and neck protective member or chinstrap of this invention as a part of the firefighter's coat.
Figure 3:
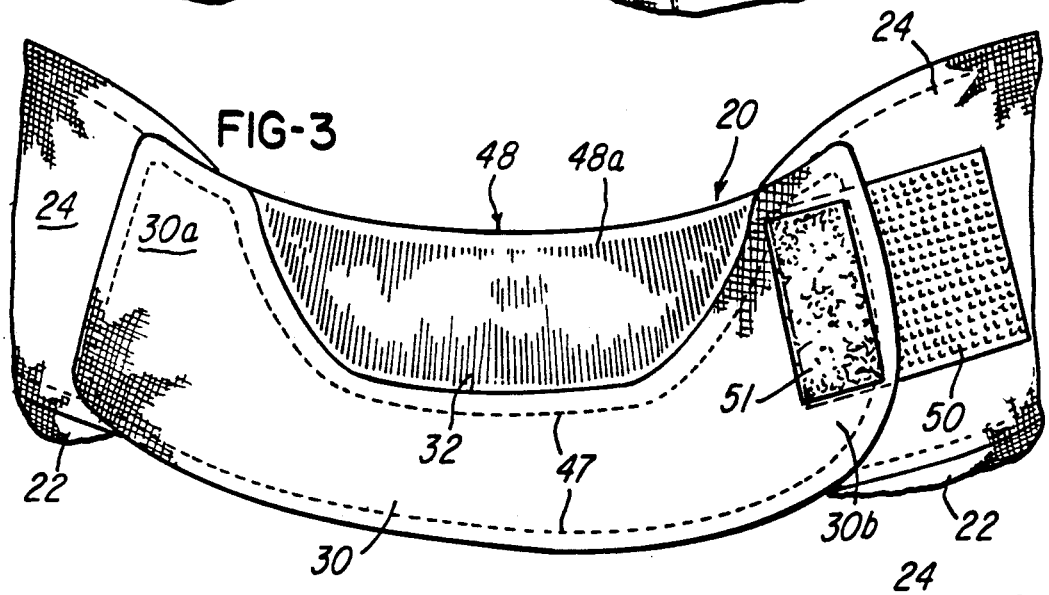
FIG. 3 is a front view, drawn on a much larger scale then FIGS. 1 and 2, showing a chinstrap of this invention in a deactivated condition.

A chinstrap 20 of this invention is shown in FIGS. 2–8. FIG. 2 shows a firefighter's coat 22 which includes a collar 24. The firefighter's coat 22 and collar 24 include firefighting protective materials, such as abrasion resistant material and thermal barrier material and moisture barrier material. These materials may comprise one layer or two layers or three layers or any desired number of layers.

The chinstrap 20 comprises a front panel 30 of abrasion resistant and flame resistant material, which for example, may be a material known as NOMEX, sold by E. I. Dupont & Co., or the front panel 30 may be of any other suitable firefighting protective material. The front panel 30 may be of the same material as that of the outer shell of the coat 22. The front panel 30 is shown as being elongate and provided with a pair of spaced-apart legs **30*a* and 30*b* which form a recess 32 between the legs 30*a* and 30*b*. The recess 32** may be curved, as shown, or of any other suitable shape.

Partially covered by the front panel 30 is an intermediate panel 34. The intermediate panel 34 comprises any suitable moisture barrier layer and may be, for example, a Neoprene material or the like. The intermediate panel 34 is preferably, but not necessarily, a double layer of material. The intermediate panel 34 is provided with a plurality of generally vertical pleats or folds **34*a***.

Behind the intermediate panel 34 is a rear panel 40, which is preferably of the same material as the front panel 30, and, preferably, has substantially the same shape and dimensions as the front panel 30. The rear panel 40 has a pair of spaced-apart legs **40*a* and 40*b* which form a recess 42 in the rear panel 40. The intermediate panel 34 is larger in area than the front panel 30 and the rear panel 40 and extends across the recesses 32 and 42 of the panels 30 and 40**.

Covering the recesses 32 and 42 of the panels 30 and 40, respectively, is a cover section 48, which is preferably, but not necessarily a double layer. The cover section 48 has a front part **48*a* which is attached to the front panel 30. The cover section 48 has a rear part 48*b* which is attached to the rear panel 40**.

The cover section 48 is constructed of thermal barrier fiber material, such as NOMEX or KEVLAR fiber or the like. The fiber is knit and woven so that the cover section can be readily stretched from the condition thereof shown in FIG. 3 to the condition thereof shown in FIG. 4.

The front panel 30 and the intermediate panel 34 and the rear panel 40 and the cover section 48 are all attached together by stitches 47 or the like.

Figure 8:
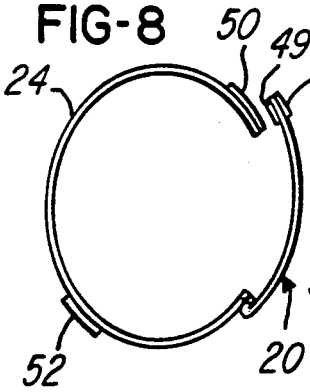
FIG. 8 is a diagrammatic view showing means for selective adjustable attachment of a movable portion of the chinstrap of this invention to the collar of a firefighter's coat for proper fitting of the chinstrap and for proper protection of the chin and neck region of the firefighter.
Figure 9:
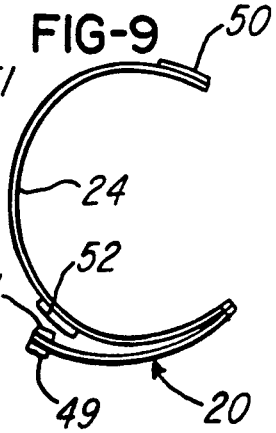
FIG. 9 is a diagrammatic view, similar to FIG. 8, showing the chinstrap out of position for protection of the chin and neck region of the firefighter who wears the coat.
Figure 7:
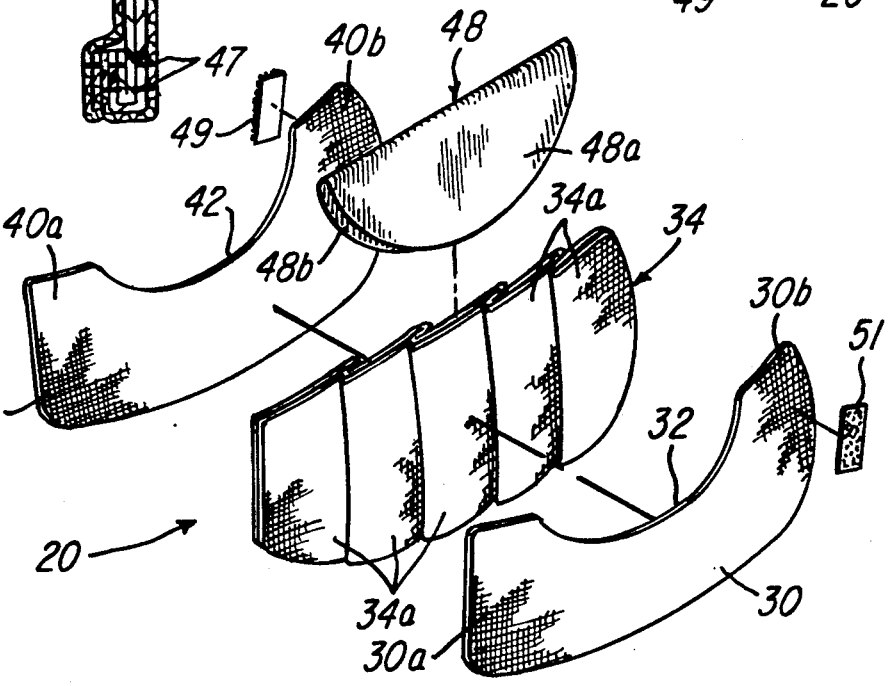
FIG. 7 is an exploded perspective view of a chinstrap of this invention.

As best shown in FIG. 8, on the surface of the leg **40*b* of the rear panel 40 is an attachment member 49, which may be, for example, a hook and pile element. The left side of the collar 24 is provided with complementary hook and pile attachment member 50 to which the attachment member 49 is attachable to maintain the chinstrap 20 in the position illustrated in FIG. 2. On the surface of the leg 30*b* of the front panel 30 is an attachment member 51, which, for example, may be a hook and pile attachment element. As shown in FIG. 9, the attachment member 51 is attachable to a hook and pile element 52 which is carried by the collar 24. Thus, the chinstrap 20 can be attached to the collar 24 as shown in FIG. 2, or the chinstrap 20 can be released from the left side of the collar 24 and attached to the right side of the collar 24 and along the right side of the head of the firefighter and away from the face and chin of the firefighter, as illustrated in FIG. 9**.

Figure 4:
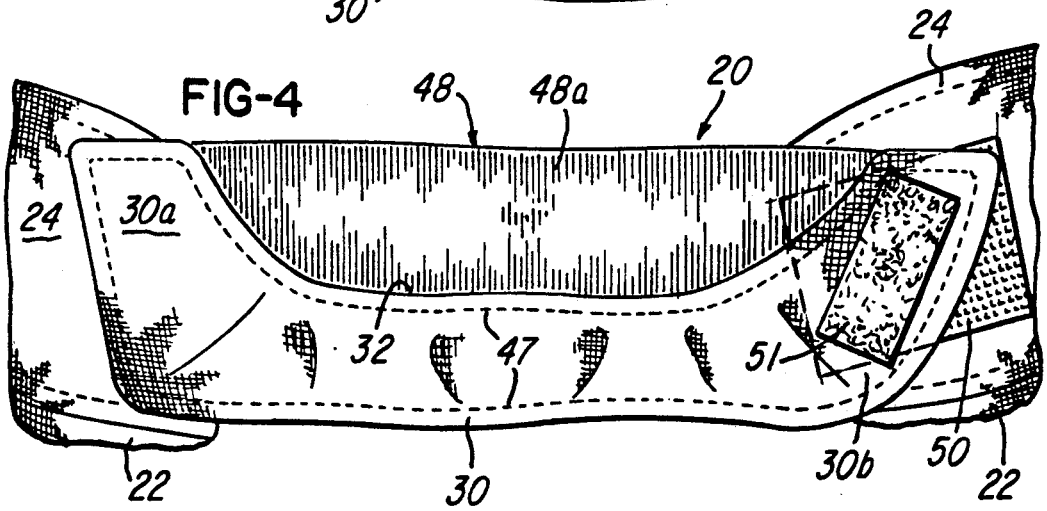
FIG. 4 is a front view, similar to FIG. 3, showing a chinstrap of this invention in an activated condition.
Figure 5:
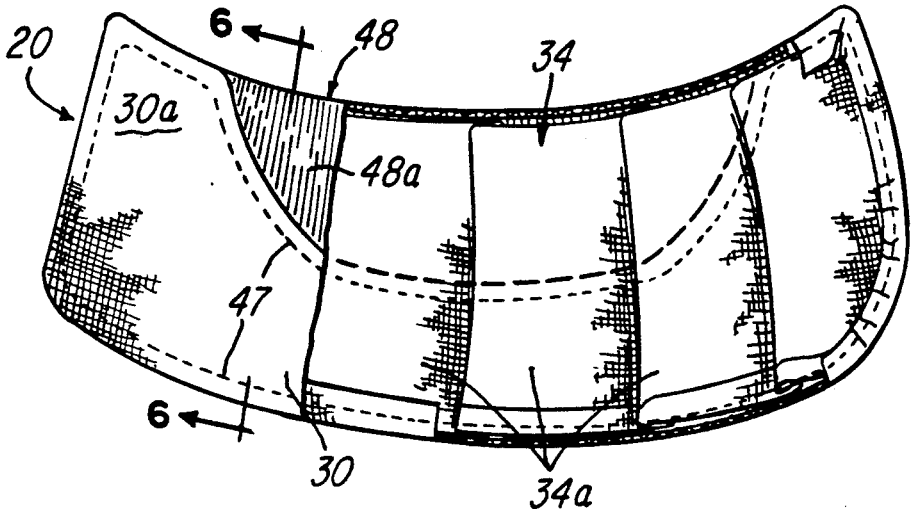
FIG. 5 is a front view with parts broken away and shown in section of a chinstrap of this invention.
Figure 6:
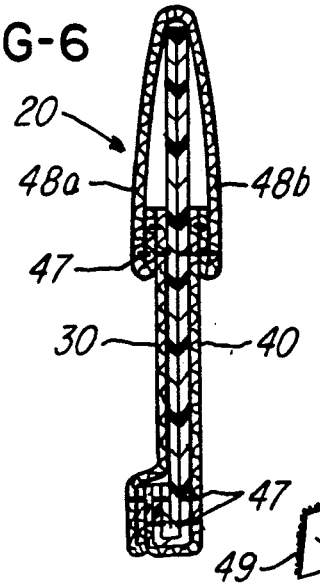
FIG. 6 is an enlarged sectional view, taken substantially on line 6—6 of FIG. 5.

As shown in FIG. 4, the legs **30*b* and 40*b* of the panels 30 and 40, which are attached together, can be moved with respect to the legs 30*a* and 40*a*, which are attached together. Thus, the cover section 48 can be stretched as the legs 30*b* and 40*b* are moved to attach the legs 30*b* and 40*b* to the left portion of the collar 24 and at the left side of the face of the firefighter. The cover section 48 is stretchable, as illustrated in FIG. 4. Therefore, the cover section 48 is stretched and the chinstrap 20 is automatically properly adjusted in length as the chinstrap 20 is brought into engagement with the chin and neck region of the firefighter who wears the coat 22**.

When the chinstrap 20 is positioned as shown in FIG. 2 the attachment element 49 of the leg **40*b* of the rear panel 40 is attached to the attachment member 50 of the collar 24, as illustrated in FIG. 2. The attachment member 50 has a significant area to permit the attachment member 49 to be attached to the attachment member 50 in any one of a plurality of positions upon the attachment member 50. Thus, the attachment member 50 has a sufficient area to permit the leg 40*b* of the rear panel 40 to be attached to the left side of the collar 24 in accordance with the desire of the firefighter who wears the coat 22. Thus, the spacing between the spaced-apart legs 40*a* and 40*b* is adjusted as desired by the firefighter who wears the firefighter's coat. Thus, the chinstrap 20 changes in shape as desired by the firefighter for obtaining a proper protective position of the chinstrap 20 with respect to the chin and neck region of the firefighter. Therefore, the chinstrap 20 is universally adapting and accommodates for any size and shape of a firefighter's neck and chin as the firefighter dons the coat 22 and positions the chinstrap 20. Also, due to the fact that the cover section 48 is of a relatively soft material, the chinstrap 20 feels comfortable to a firefighter as the cover section 48** engages the chin and neck region of the firefighter.

Thus, it is understood that a chinstrap 20 of this invention includes firefighting protective materials, while also providing a properly fitting and comfortable chinstrap.

Although the preferred embodiment of a chinstrap of this invention has been described, it will be understood that within the purview of this invention various changes may be made in the form, details, proportion and arrangement of parts, the combination of parts, and the manner of construction and use, which generally stated consist in a firefighter's chinstrap within the scope of the appended claims.

The invention having thus been described, the following is claimed:

1. A chin and neck protective member for a firefighter who wears a firefighter's coat, the chin and neck protective member being adapted to be attached to the firefighter's coat adjacent the chin and neck regions of the firefighter who wears the firefighter's coat, the chin and neck protective member comprising a body of firefighting protective material including thermal barrier material and moisture barrier material, the body of firefighting protective material having spaced-apart portions which are relatively movable, the body of firefighting protective material having an expansible portion which is expansible and contractible in effective area, whereby the spaced-apart portions of the body of firefighting material are relatively movable for adjustable attachment to a firefighter's coat, and whereby the expansible portion of the body of firefighting protective material expands in effective area as the spaced-apart portions thereof are moved one from the other, and whereby the chin and neck protective member accommodates for the size and shape of the chin and neck region of any firefighter who wears the firefighter's coat, and whereby the chin and neck protective member properly covers and protects the chin and neck region of any firefighter who wears the firefighter's coat.

2. The chin and neck protective member of claim 1 in which the expansible portion of the body of firefighting protective material includes stretchable material.

3. The chin and neck protective member of claim 1 in which the body of firefighting protective material includes a layer of moisture barrier material and a layer of thermal barrier material.

4. The chin and neck protective member of claim 1 in which the body of firefighting protective material includes a layer of moisture barrier material and a layer of thermal barrier material, and in which at least one of the layers includes stretchable material.

5. A method of providing a chin and neck protective member for a firefighter's coat having an upper portion in which the upper portion is adapted to be positioned adjacent the chin and neck region of a firefighter who wears the firefighter's coat, comprising providing a body of firefighting protective material in which the body of firefighting protective material includes an expansible portion which is expansible in effective area, forming a pair of spaced-apart relatively movable portions in the body of firefighting protective material, attaching one of spaced-apart portions of the body of firefighting protective material to the firefighter's coat adjacent the upper portion thereof, attaching the other of the spaced-apart portions of the body of firefighting material to a desired position at the upper portion of the firefighter's coat at a desired position with respect to the first of the spaced-apart portions and in accordance with the size and configuration of the chin and neck regions of the firefighter who wears the firefighter's coat, whereby the body of firefighting protective material is changeable in effective area as the spaced-apart portions are attached to the firefighter's coat and as the expansible portion of the body of firefighting material assumes an area in accordance with the relative positions of the spaced-apart portions of the body of firefighting material and in accordance with the size and configuration of the chin and neck regions of the firefighter who wears the coat, and whereby the chin and neck protective member properly protects the chin and neck region of any firefighter who wears the firefighter's coat.

6. The method of claim 5 in which the body of firefighting protective material which is provided includes a stretchable portion.

7. The method of claim 5 which includes forming a recess in the body of firefighting protective material between the two spaced-apart portions.

8. The method of claim 5 which includes forming a recess between the two spaced-apart portions of the body of firefighting protective material, and positioning a layer of stretchable firefighting protective material between the spaced-apart portions.

9. The method of claim 5 which includes forming a recess between the spaced-apart portions of the body of firefighting protective material, and which includes positioning a layer of stretchable firefighting protective material between the spaced-apart portions of the layer of firefighting protective material, and followed by attaching the layer of stretchable firefighting protective material to the spaced-apart portions of the body of firefighting protective material, whereby relative movement of the spaced-apart portions one from the other causes stretching of the layer of stretchable material.

10. A chin and neck protective member for a firefighter who wears a firefighter's coat, the chin and neck protective member being adapted to be attached to spaced-apart portions of the firefighter's coat adjacent the upper portion of the firefighter's coat and adjacent the chin and neck regions of the firefighter who wears the firefighter's coat, the chin and neck protective member comprising a body of firefighting protective material including thermal barrier material and moisture barrier material, the body of firefighting protective material including spaced-apart attachment portions which are attachable to the spaced-apart portions of the firefighter's coat, the body of firefighting protective material including a portion which is expansible and contractible in effective area and which is changeable in configuration, whereby the spaced-apart attachment portions of the body of firefighting protective material are relatively movable for adjustable attachment to the upper portion of a firefighter's coat, and whereby the body of firefighting protective material changes in configuration and effective area as the spaced-apart portions of the body of firefighting material are moved one with respect to the other, and whereby the chin and neck protective member accommodates for the size and shape of the chin and neck region of any firefighter and neck protective member properly covers and protects the chin and neck region of any firefighter who wears the firefighter's coat.

11. A method of providing a chin and neck protective member for a firefighter's coat having an upper portion in which the upper portion is adapted to be positioned adjacent the chin and neck region of a firefighter who wears the firefighter's coat, comprising providing a body of firefighting protective material in which the body of firefighting protective material includes a changeable portion which is changeable in configuration and which is also changeable in effective area, forming a pair of spaced-apart attachment portions in the body of firefighting protective material, attaching one of spaced-apart attachment portions of the body of firefighting protective material to the firefighter's coat adjacent the upper portion thereof, attaching the other of the spaced-apart attachment portions of the body of firefighting material to a desired position at the upper portion of the firefighter's coat at a desired position with respect to the first of the spaced-apart attachment portions and in accordance with the size and configuration of the chin and neck regions of the firefighter who wears the firefighter's coat, whereby the body of firefighting protective material changes in configuration and effective area as the spaced-apart attachment portions are attached to the firefighter's coat and as the changeable portion of the body of firefighting material assumes a configuration and effective area in accordance with the relative positions of the spaced-apart portions of the body of firefighting material and in accordance with the size and configuration of the chin and neck regions of the firefighter who wears the coat, and whereby the chin and neck protective member properly protects the chin and neck region of any firefighter who wears the firefighter's coat.

12. The method of claim 11 in which the body of firefighter protective protective material which is provided includes a stretchable portion.

13. The method of claim 11 which includes forming a recess in the body of firefighting protective material between the two spaced-apart portions.

14. The method of claim 11 which includes forming a recess between the two spaced-apart portions of the body of firefighting protective material, and positioning a layer of stretchable firefighting protective material between the spaced-apart portions.

15. The method of claim 11 which includes forming a recess between the spaced-apart portions of the body of firefighting protective material, and which includes positioning a layer of stretchable firefighting protective material between the spaced-apart portions of the body of firefighting protective material, and followed by attaching the layer of stretchable firefighting protective material to the spaced-apart portions of the body of firefighting protective material, whereby relative movement of the spaced-apart portions one from the other causes stretching of the layer of stretchable firefighting protective material.

* * * * *

UNITED STATES PATENT AND TRADEMARK OFFICE

CERTIFICATE OF CORRECTION

PATENT NO. : 5,167,037

DATED : December 1, 1992

INVENTOR(S) : William L. Grilliot and Mary I. Grilliot

It is certified that error appears in the above-identified patent and that said Letters Patent is hereby corrected as shown below:

Column 6, line 52, after "firefighter" insert ---who wears the firefighter's coat, and whereby the chin---.

Signed and Sealed this

Sixteenth Day of November, 1993

*Attest:*

*Attesting Officer*

BRUCE LEHMAN

*Commissioner of Patents and Trademarks*